US008573279B2

(12) United States Patent
Fueki

(10) Patent No.: US 8,573,279 B2
(45) Date of Patent: Nov. 5, 2013

(54) COATING FILM TRANSFER TOOL

(75) Inventor: Kazui Fueki, Tokyo (JP)

(73) Assignee: Plus Corporation, Tokyo (JP)

( * ) Notice: Subject to any disclaimer, the term of this patent is extended or adjusted under 35 U.S.C. 154(b) by 0 days.

(21) Appl. No.: 13/292,751

(22) Filed: Nov. 9, 2011

(65) Prior Publication Data

US 2012/0118509 A1 May 17, 2012

(30) Foreign Application Priority Data

Nov. 15, 2010 (JP) ..... 2010-254664

(51) Int. Cl.

| | |
|---|---|
| ***B44C 7/00*** | (2006.01) |
| ***B29C 65/00*** | (2006.01) |
| ***B65H 37/00*** | (2006.01) |
| ***B32B 38/10*** | (2006.01) |

(52) U.S. Cl.

USPC ..... 156/577; 156/579; 156/540; 156/523; 156/530; 156/574

(58) Field of Classification Search

USPC ..... 156/577, 579

See application file for complete search history.

(56) References Cited

U.S. PATENT DOCUMENTS 7,654,297 B2 * 2/2010 Wu ..... 156/577

* cited by examiner

*Primary Examiner* — Philip Tucker
*Assistant Examiner* — Alex Efta
(74) *Attorney, Agent, or Firm* — The Marbury Law Group, PLLC

(57) ABSTRACT

A coating film transfer tool in which refills can be replaced and which can be switched between a useable state and a non-useable state through a pushing operation includes a case main body accommodating a refill having a front case and a rear case. The rear case is detachably attached to the front case. An opening from which a transfer head can project is formed at a front end of the front case. The rear case has a push mechanism having an elastic member configured to cause the transfer member to appear from and disappear into the opening, a push button which operates the push mechanism, and an engagement portion extending to the front from the push mechanism that moves in a front-to-rear direction within the case main body in response to the push mechanism. The engagement portion attaches near a rear end of the refill to support the refill.

2 Claims, 8 Drawing Sheets

COATING FILM TRANSFER TOOL

CROSS-REFERENCE TO RELATED APPLICATION

This patent application is based upon and claims the benefit of priority under 35 USC 119 of Japanese Patent Application No. 2010-254664 filed on Nov. 15, 2010, the entire disclosure of which, including the description, claims, drawings and abstract, is incorporated herein by reference.

BACKGROUND OF THE INVENTION

1. Technical Field

The present invention relates to a coating film transfer tool which enables the replacement of refills having a transfer tape and more particularly to a coating film transfer tool in which a transfer head is caused to appear and disappear through operation of a push mechanism.

2. Description of Related Art

Coating film transfer tools for transferring a coating film of a correction tape or a glue tape to a transfer-receiving surface are now indispensable as stationery. In general, a coating film transfer tool includes a transfer tape made up of a coating film and a base tape, a feed spool around which an unused transfer tape is wound, a take-up spool which takes up the used transfer tape (the base tape), and a transfer head which presses the transfer tape against a sheet of paper or the like. When caused to slide on a transfer-target object such as a sheet of paper in such a state that the transfer head is kept pressed against the sheet of paper, the coating film transfer tool can pressure-sensitively transfer a coating film on to the transfer-target object.

Conventionally, many of such coating film transfer tools were of the disposable type. In recent years, however, in order to reduce wastes with a view to protecting the environment or from an economical point of view, a type of coating film transfer tools which enables the refill or replacement of transfer tapes constitutes the mainstream of currently marketed coating film transfer tools. In addition, there has also been proposed a transfer head retractable coating film transfer tool in which a retractable transfer head is provided which is retracted or is caused to appear and disappear by operating a push mechanism so that the coating film transfer tool is switched between a usable state and a non-usable state.

For example, JP-A-2004-291284 proposes a retractable transfer head coating film transfer tool in which refills (a coating film transfer tool main body) incorporating a transfer tape are replaced.

In the coating film transfer tool described in the aforesaid patent literature, a coil spring is disposed in front of a refill (a coating film transfer tool main body) so as to bias the refill towards the rear, whereby the refill is connected to a push mechanism.

Because of this, in this coating film transfer tool in which the coil spring is disposed between a front interior of a front case and the refill, when the front case and a rear case are separated from each other in an attempt to replace the refill which has been used up with a fresh refill, there have been fears that the existing refill is forced out to the rear by virtue of the elastic force of the coil spring.

SUMMARY OF THE INVENTION

The invention has been made in view of the problem which is inherent in conventional push-type refill replaceable coating film transfer tools like one that has been described above, and an object of the invention is to provide a coating film transfer tool which prevents an existing refill from being forced out of the transfer tool when refills are attempted to be replaced.

According to a first aspect of the invention, there is provided a coating film transfer tool comprising: a refill; and a case main body, the refill being incorporated in the coating film transfer tool, having a feed spool around which an unused transfer tape is wound, a transfer head from which the transfer tape is suspended and which presses a coating film on the transfer tape against a transfer target so as to pressure-sensitively transfer the coating film on to the transfer target, and a take-up spool which takes up the transfer tape from which the coating film has been transferred, and being able to be replaced, the case main body accommodating therein the refill and comprising a front case in which an opening from which the transfer head is allowed to project is formed at a front end thereof, and a rear case having a push mechanism which causes the transfer head to appear from and disappear into the opening, wherein the rear case is detachably attached to the front case, wherein the push mechanism has an elastic member and an engagement portion which extends to the front from the push mechanism and moves in a front-to-back direction in the case main body according to the operation of the push mechanism, and wherein the engagement portion is detachably attached to the vicinity of a rear end of the refill to support the refill.

According to a second aspect of the invention, there is provided a coating film transfer tool as set forth in the first aspect, wherein the engagement portion and the refill are connected together by an engagement claw portion provided in the vicinity of the rear end of the refill being brought into engagement with an engagement opening provided in the vicinity of a front end of the engagement portion, wherein a connection release member which releases the connection of the engagement portion with the refill is secured to the rear case, and the connection release member is an elastically deformable plate-shaped member which extends in the front-to-rear direction and has a pressing portion and an engaging attachment projection, the pressing portion being caused to project inwards from the plate-shaped member, the engaging attachment projection being caused to project outwards from the vicinity of a front end of the plate-shaped member and adapted to be securely inserted into an engaging attachment opening provided in the vicinity of a rear end of the front case, whereby the front case and the rear case are connected together, wherein by the connecting release member being pressed from outside, the pressing portion presses against the engagement claw portion so that the engagement claw portion is disengaged from the engaging attachment opening, and wherein by the connecting release member being pressed further inwards, the engaging attachment projection is disengaged from the engaging attachment opening in the front case.

According to a third aspect of the invention, there is provided a coating film transfer tool as set forth in the second aspect, wherein the engagement portion comprises a restricting portion which is provided to the rear of the engagement opening so as to restrict an inward movement of the pressing portion of the connection release member, and in a usable state in which the transfer head projects from the opening in the front case, the restricting portion is situated in the vicinity of the pressing portion.

According to the invention, the front case and the rear case are connected together detachably, and the push mechanism is provided in the rear case. In addition, the engagement portion situated at the front end of the push mechanism is detachably attached to the rear end of the refill. By adopting this configuration, the elastic member constituting the push mechanism can be disposed within the rear case. Consequently, the coating film transfer tool can be provided which prevents the refill from being forced out when the case main body which accommodates therein the refill is separated into the front case and the rear case.

DETAILED DESCRIPTION OF THE PREFERRED EMBODIMENT

A mode for carrying out the invention will be described by reference to the drawings.

Figure 1:
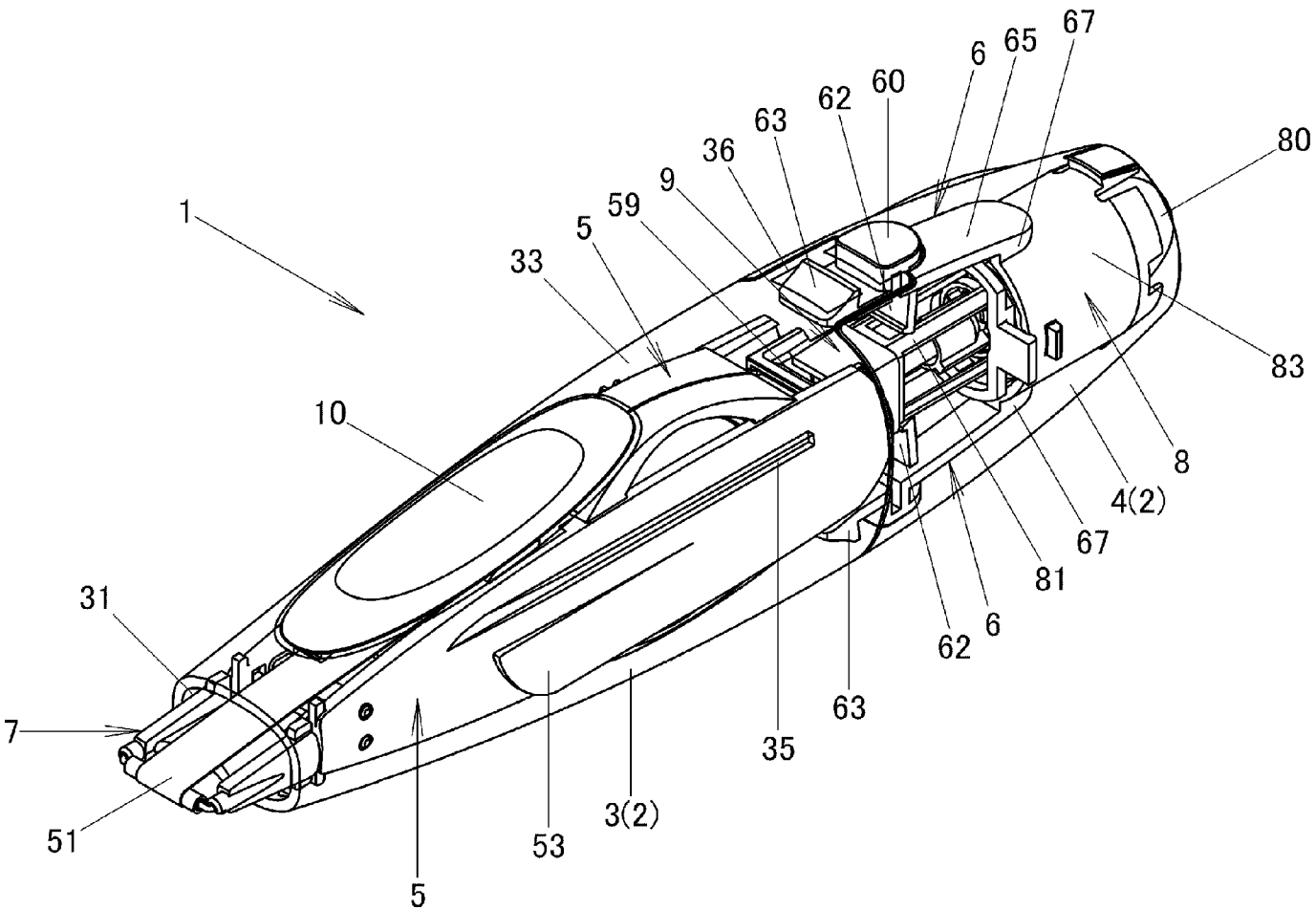
FIG. 1 is an external perspective view of a coating film transfer tool according to an embodiment of the invention when the coating film transfer tool is in a useable state.
Figure 2:
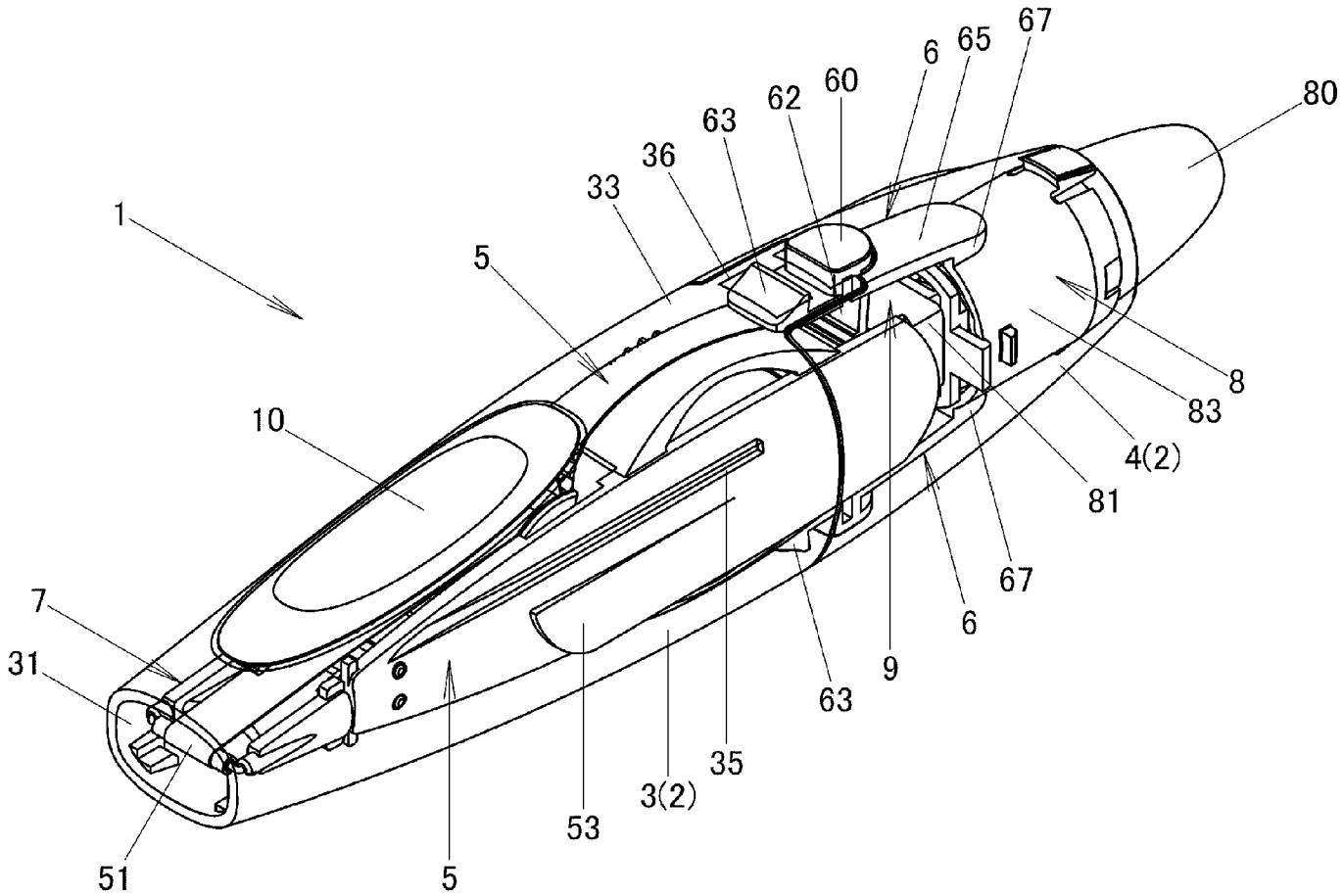
FIG. 2 is an external perspective view of the coating film transfer tool according to the embodiment of the invention when the coating film transfer tool is in a non-useable state.
Figure 3:
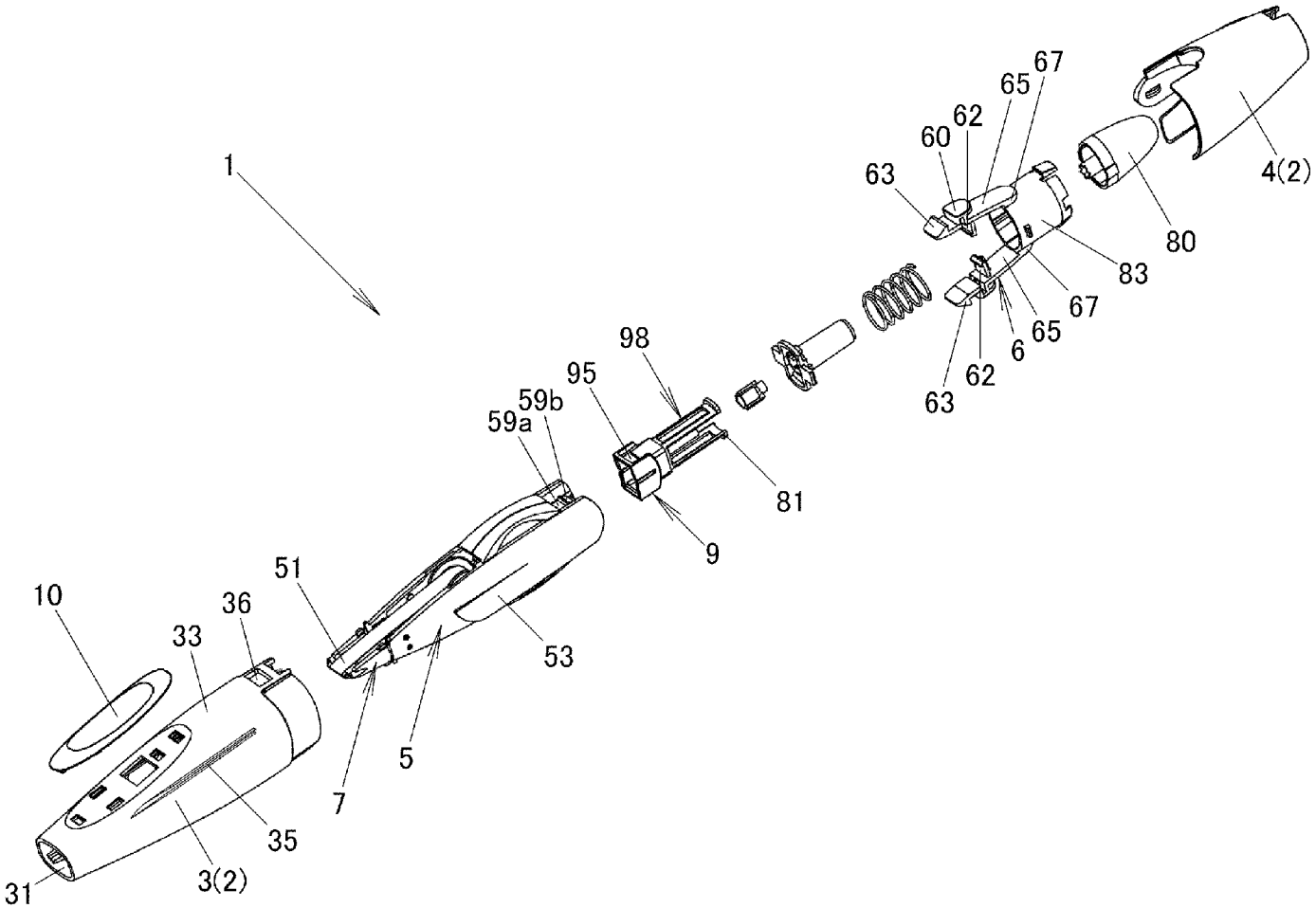
FIG. 3 is an exploded perspective view of the coating film transfer tool according to the embodiment of the invention.

FIGS. 1 and 2 are external perspective views of a coating film transfer tool 1 according to an embodiment of the invention when the coating film transfer tool is in a useable state and in a non-useable state, respectively. In addition, FIG. 3 is an exploded perspective view of the coating film transfer tool 1. In this specification, a direction in which a transfer head 7 of the coating film transfer tool 1 is situated in FIG. 1 is referred to as front or forward, a direction in which a push button 80 which constitutes an operating portion of a push mechanism 8 is situated is referred to as rear or rearward, a direction in which a cushion material 10 to which the index finger is applied is situated is referred to as up or upward, and a direction opposite thereto is referred to as down or downward. In addition, a direction which intersects a front-to-rear direction and a up-to-down direction at right angles is referred to as a lateral direction (a left-to-right direction).

The coating film transfer tool 1 according to the embodiment includes a case main body 2 which is made up of a front case 3 and a rear case 4 which can freely be attached to and detached from each other and a refill 5 which can be accommodated within the case main body 2. This rear case 4 has a push mechanism 8 which includes an elastic member so as to cause a transfer head 7 of the refill 5 to appear from and disappear into a front end of the front case 3 and an engagement portion 9 which extends to the front from the push mechanism 8 and moves in a front-to-rear direction in association with the operation of the push mechanism 8. Then, by the engagement portion 9 being brought into engagement with a rear end of the refill 5, the refill 5 is held by the rear case 4 in a position lying further forwards than the elastic member of the push mechanism 8. In addition, the coating film transfer tool 1 also includes a release mechanism which can release the engaging state of the engagement portion 9 with the refill 5 and the connected state of the front case 3 with the rear case 4 through a single operation. Hereinafter, this coating film transfer tool 1 will be described in a specific fashion.

The coating film transfer tool 1 is sized so as to be held by a hand of a user as he or she holds a pen. The coating film transfer tool 1 is a device which can pressure-sensitively transfer a coating film of a transfer tape 51, in which the coating film is engagingly attached to a base tape, on to a transfer target such as a sheet of paper when the transfer head 7 is caused to slide on the transfer target while being pressed thereagainst.

The coating film transfer tool 1 includes the refill 5 which is accommodated in the case main body 2. The refill 5 so accommodated can be replaced with a fresh refill by separating the case main body 2 into the front case 3 and the rear case 4. In addition, the coating film transfer tool 1 also includes the push mechanism 8 which operates the refill 5 in the front-to-rear direction. By this push mechanism 8 being operated, the transfer head 7 is caused to appear from and disappear into the front end of the front case 3 of the case main body 2 as is shown in FIGS. 1 and 2.

The front case 3 includes at the front end thereof an opening 31 through which the transfer head 7 is allowed to project. The front case 3 also includes a cushion material 10 made of rubber and so forth at a portion on an upper surface 33 thereof which is gripped by the user when the coating film transfer tool 1 is used. In addition, the rear case 4 which incorporates therein the push mechanism 8 is designed to define a space which can accommodate a part like the refill 5 within the case main body 2 when it is integrally attached to the front case 3. Further, a through hole is formed at a rear end of the rear case 4 so that a push button 80 is allowed to project therethrough. The push button 80 is provided in the rear case 4 so as to operate the push mechanism 8 when operated.

This push mechanism 8 is a mechanism which moves back and forth in the front-to-rear direction every time the push button 80 is pushed so as to be fixed in a forward or rearward predetermined position. This mechanism is nothing like a new special mechanism and has been known for a long time as a mechanism which switches a ballpoint pen between a state in which a writing tip of an ink cartridge of the ballpoint pen is allowed to project from a tip of a casing of the ballpoint pen and a state in which the tip of the ink cartridge is accommodated totally within the casing. Thus, the detailed description of the push mechanism 8 will be omitted here. In this embodiment, however, the elastic member such as a coil spring is installed in the rear case 4 for restoring the push mechanism 8 from the pushed state to the original state.

The refill 5 accommodated in the case main body 2 is a refill part which is made up of the transfer tape 51, a feed spool, the transfer head 7, a take-up spool, a link member which links the feed spool with the take-up spool and a refill case which accommodate these constituent parts. An internal mechanism (an internal construction of the refill case) may adopt the conventionally existing mechanism or construction, and therefore, the detailed description thereof will be omitted here.

Figure 4:
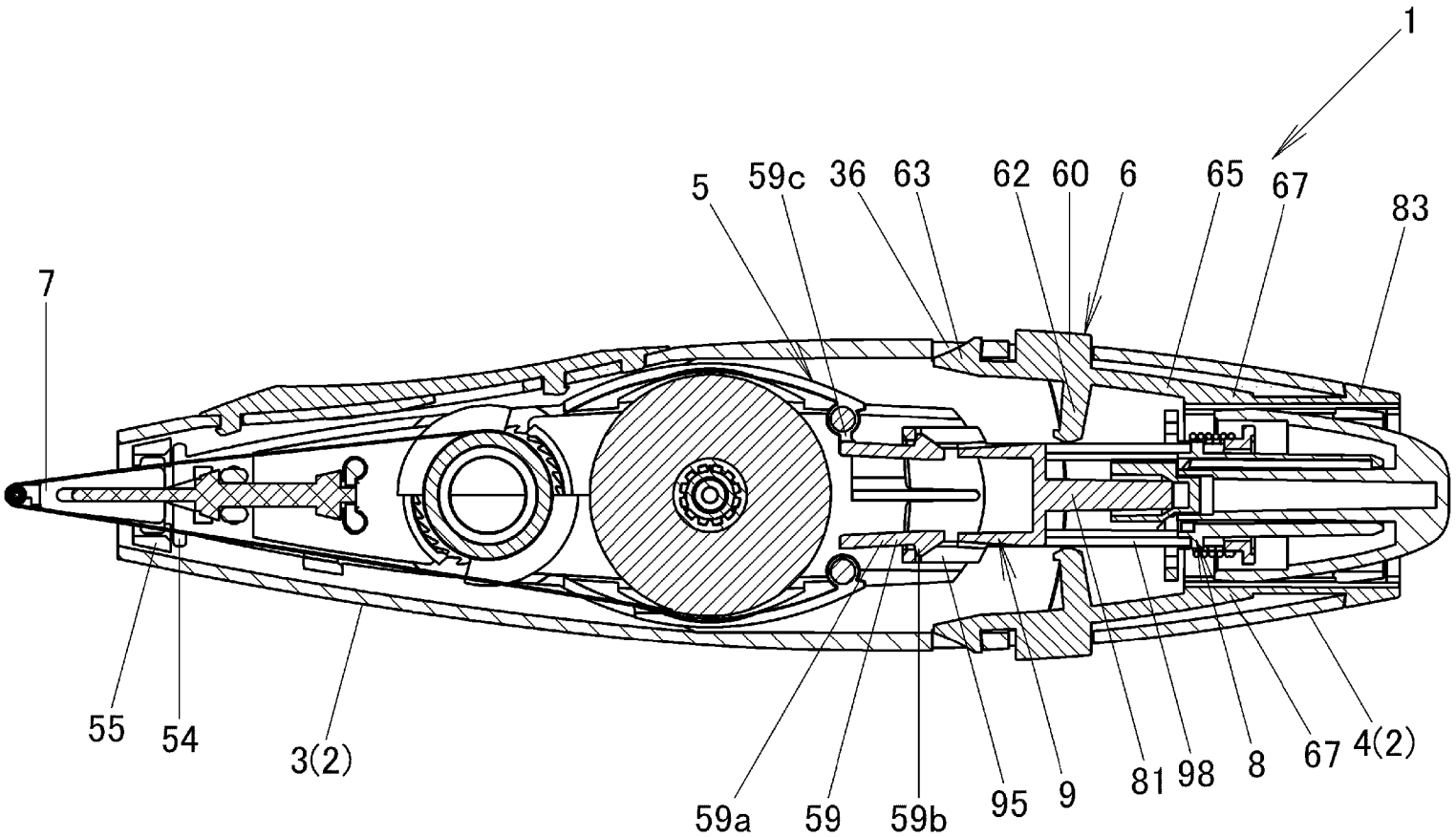
FIG. 4 is a sectional view of the coating film transfer tool according to the embodiment of the invention when the coating film transfer tool is in the useable state.
Figure 5:
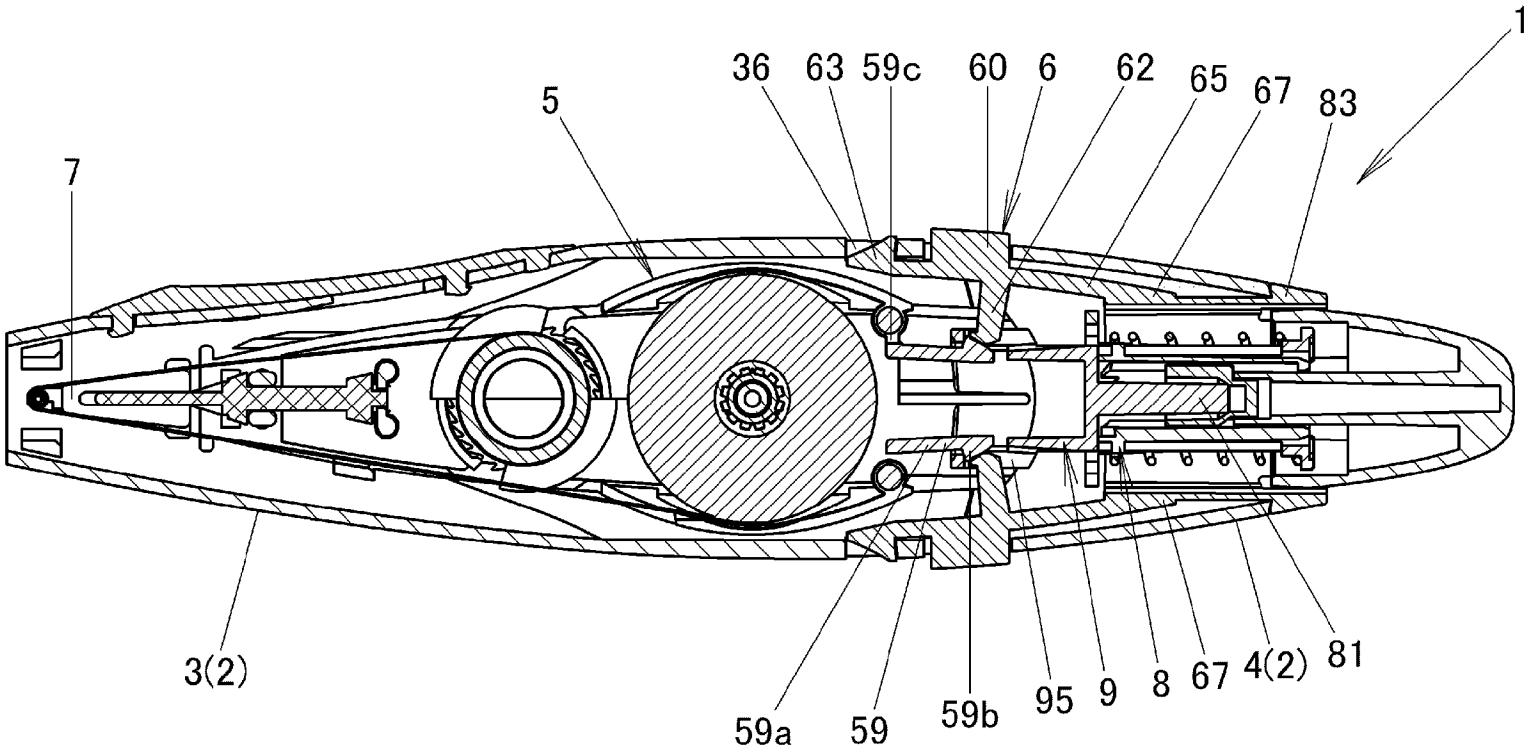
FIG. 5 is a sectional view of the coating film transfer tool according to the embodiment of the invention when the coating film transfer tool is in the non-useable state.

Next, a connecting construction of the coating film transfer tool 1 according to the embodiment will be described which connects the refill 5 with the engagement portion 9. Since the engagement portion 9 is provided at a front end of the push mechanism 8, when the refill 5 and the engagement portion 9 of the push mechanism 8 are connected together, the refill 5 is coupled to the rear case 4 via the engagement portion 9 (and the push mechanism 8). FIGS. 4 and 5 are sectional views showing a useable state and a non-useable state of the coating film transfer tool 1 according to the embodiment, respectively.

As shown in the figures, the push mechanism 8 includes a moving member 81. This moving member 81 moves in the front-to-rear direction within the case main body 2 as the push mechanism 8 is operated, and the engagement portion 9 is formed in the moving member 81. Specifically, the engagement portion 9 is formed at a front end portion of the moving member 81 and is detachably attached to the vicinity of a rear end of the refill 5. More specifically, a pair of engagement claw portions 59 having claws 59*b* which project vertically outwards are formed in the vicinity of a rear end of the refill 5. A pair of engagement openings 95 are formed in the vicinity of a front end of the engagement portion 9, and the claws 59*b* of the engagement claw portions 59 are brought into engagement with those engagement openings 95.

The engagement claw portions 59 are secured to the vicinity of the rear end of the refill 5. Each engagement claw portion 59 has a plate-shaped member 59*a* which extends to the rear from a securing portion 59*c* and the claw 59*b* which projects vertically outwards at a rear end of the plate-shaped member 59*a*. The pair of plate-shaped members 59*a* can deform vertically inwards in an elastic fashion through the securing portion 59*c* which functions as a fixed end. A tapered portion is formed on each claw 59*b*, and this tapered portion is a slope which extends obliquely outwards and forwards from a rear end of the claw 59*b*.

Consequently, the engagement portion 9 and the refill 5 are connected together by the claws 59*b* of the engagement claw portions 59 being securely inserted in the corresponding engagement openings 95 when the engagement claw portions 59 are inserted into the engagement portion 9. On the contrary, the connection of the engagement portion 9 with the refill 5 is released by the plate-shaped members 59*a* being deflected inwards so that the claws 59*b* are disengaged from the corresponding engagement openings 95 when the claws 59*b* of the engagement claw portions 59 are pressed inwards.

Next, a pair of connection release members 6 will be described. The connection release members 6 are constituent members of the aforesaid connection release mechanism which releases the connection of the refill 5 with the engagement portion 9. In addition, the connection release members 6 connect the front case 3 with the rear case 4. The connection release members 6 are each configured as a plate-shaped member 65 which extends in the front-to-rear direction and can be deformed elastically. A rear end of the plate-shaped member 65 is configured as a securing portion 67. Then, the connection release members 6 are secured to a non-movable member 83 via the securing portions 67. The non-movable member 83 is a member which is part of the push mechanism 8 and is fixed to the rear case 4 so as not to move. In addition, pressing portions 62 are formed at front ends of the plate-shaped members 65 which constitute the connection release members 6 so as to project inwards. Tapered surfaces are provided at distal ends (inner end portions) of the pressing portions 62. Further, operating portions 60 are formed on opposite sides of the plate-shaped members 65 to the sides where the pressing portions 62 are formed in positions corresponding to the pressing portions 62. The operating portions 60 are formed so as to project outwards and can be operated by fingers of the user from the outside.

Namely, in this connection release members 6, when the operating portions 60 are operated from the outside so as to be pressed inwards, the plate-shaped members 65 can be deflected inwards in such a way that the front ends where the pressing portions 62 are formed move inwards from the securing portions 67 which function as fixed ends. Then, as is shown in FIG. 5, the pressing portions 62 are disposed so that distal ends of the pressing portions 62 face the claws 59*b* of the engagement claw portions 59 of the refill 5 in such a state that the transfer head 7 is installed in the front case 3 (the non-useable state). Namely, the pressing portions 62 are provided in positions which correspond to the positions where the engagement openings 95 are formed when the coating film transfer tool 1 is in the non-useable state in which the transfer head 7 is installed in the front case 3.

Consequently, when the operating portions 60 on the connection release members 6 are pressed inwards, the pressing portions 62 are brought into contact with the corresponding claws 59*b* of the engagement claw portions 59. As this occurs, the claws 59*b* are pressed inwards by the pressing portions 62, whereby the claws 59*b* are disengaged from the engagement openings 95, thereby making it possible to release the connection of the refill 5 with the engagement portion 9.

Further, in the coating film transfer tool 1, when the connection release members 6 are pressed inwards when the tool is not in use, not only can the connection of the engagement portion 9 with the refill 5 be released, but also the connection of the front case 3 with the rear case 4 can be released through the series of operations.

The connection of the front case 3 with the rear case 4 and the release (separation) thereof will be described. In this coating film transfer tool 1, engaging attachment projections 63, which project vertically outwards, are formed in the vicinity of front ends of the plate-shaped members 65 of the pair of connection release members 6. In contrast, a pair of engaging attachment openings 36 are formed in the vicinity of the rear end of the front case. These engaging attachment openings 36 are configured as depressed portions in which the engaging attachment projections 63 of the connection release members 6 are engagingly attached. In addition, a tapered portion is formed on each engaging attachment projection 63 as a slope which extends obliquely outwards and rearwards from a front end thereof.

Namely, the front case 3 and the rear case 4 are connected together by the engaging attachment projections 63 of the connection release members 6 being engagingly attached in the engaging attachment openings 36 in the front case 3. Consequently, in this coating film transfer tool 1, the engagement of the engagement portion 9 with the refill 5 can be released by deflecting the plate-shaped members 65 of the connection release members 6 inwards by pressing the operating portions 60 of the connection release members 6 from the outside. Further, the connection of the front case 3 with the rear case 4 can also be released by disengaging the engaging attachment projections 63 from the engaging attachment openings 36 in the front case 3 where the engaging attachment projections 63 are engagingly attached by pressing inwards the operating portions 60 of the connection release members 6.

In addition, the engagement portion 9 includes restricting portions 98 in positions (directly below inner ends of the pressing portions 62) which correspond to the pressing portions 62 of the connection release members 6 in such a state that the transfer head 7 projects to the front from the front case 3 (the useable state). These restricting portions 98 restrict the inward movement of the pressing portions 62. Namely, the engagement portion 9 includes the restricting portions 98 to the rear of the engagement openings 95. In the useable state, the restricting portions 98 are situated in proximity to inner end portions of the pressing portions 62. Because of this, the connection release members 6 are prevented from being pressed, whereby the connection of the front case 3 with the rear case 4 cannot be implemented.

Figure 6:
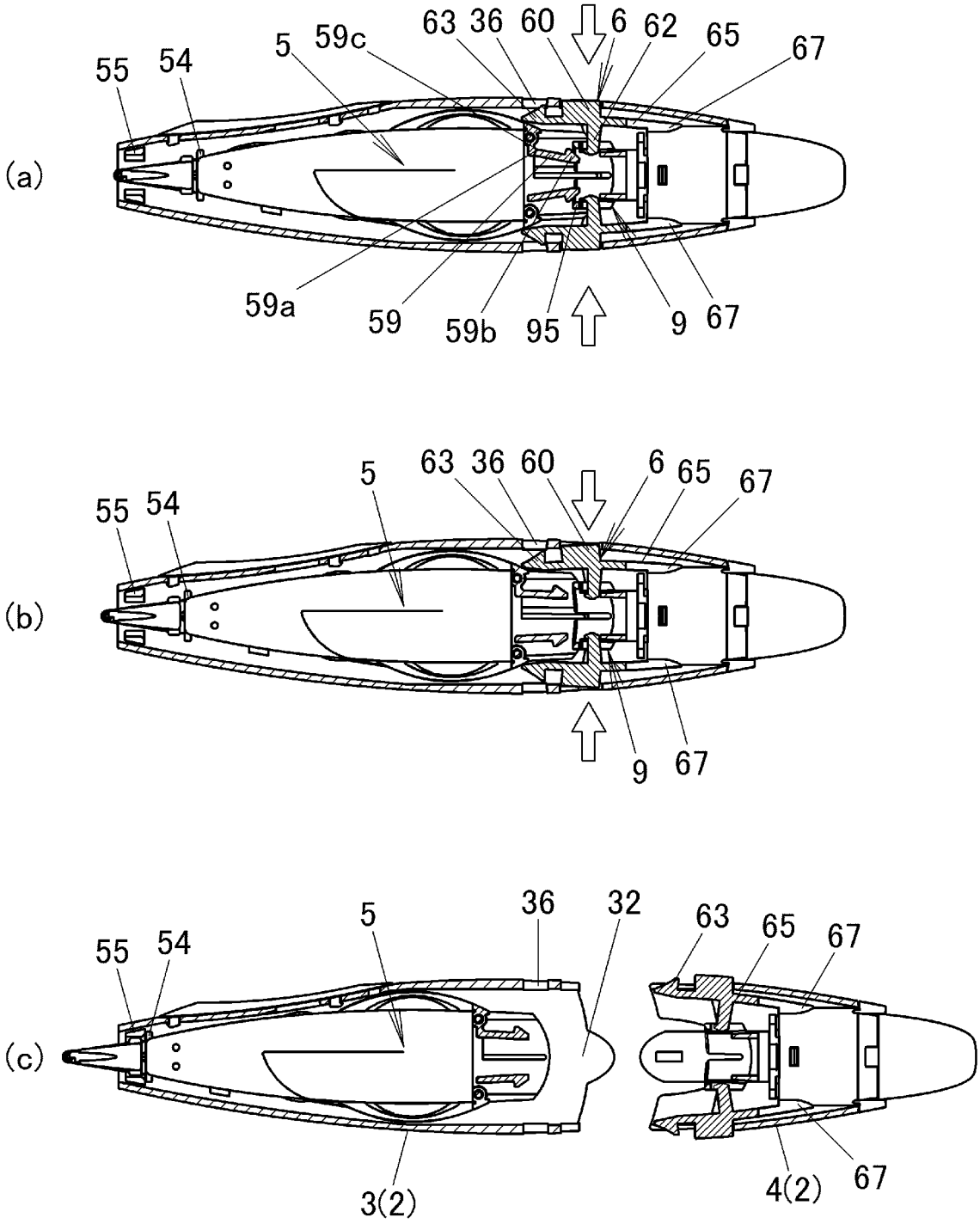
FIG. 6 shows a series of connection releasing operations in the coating film transfer tool according to the embodiment of the invention.
Figure 7:
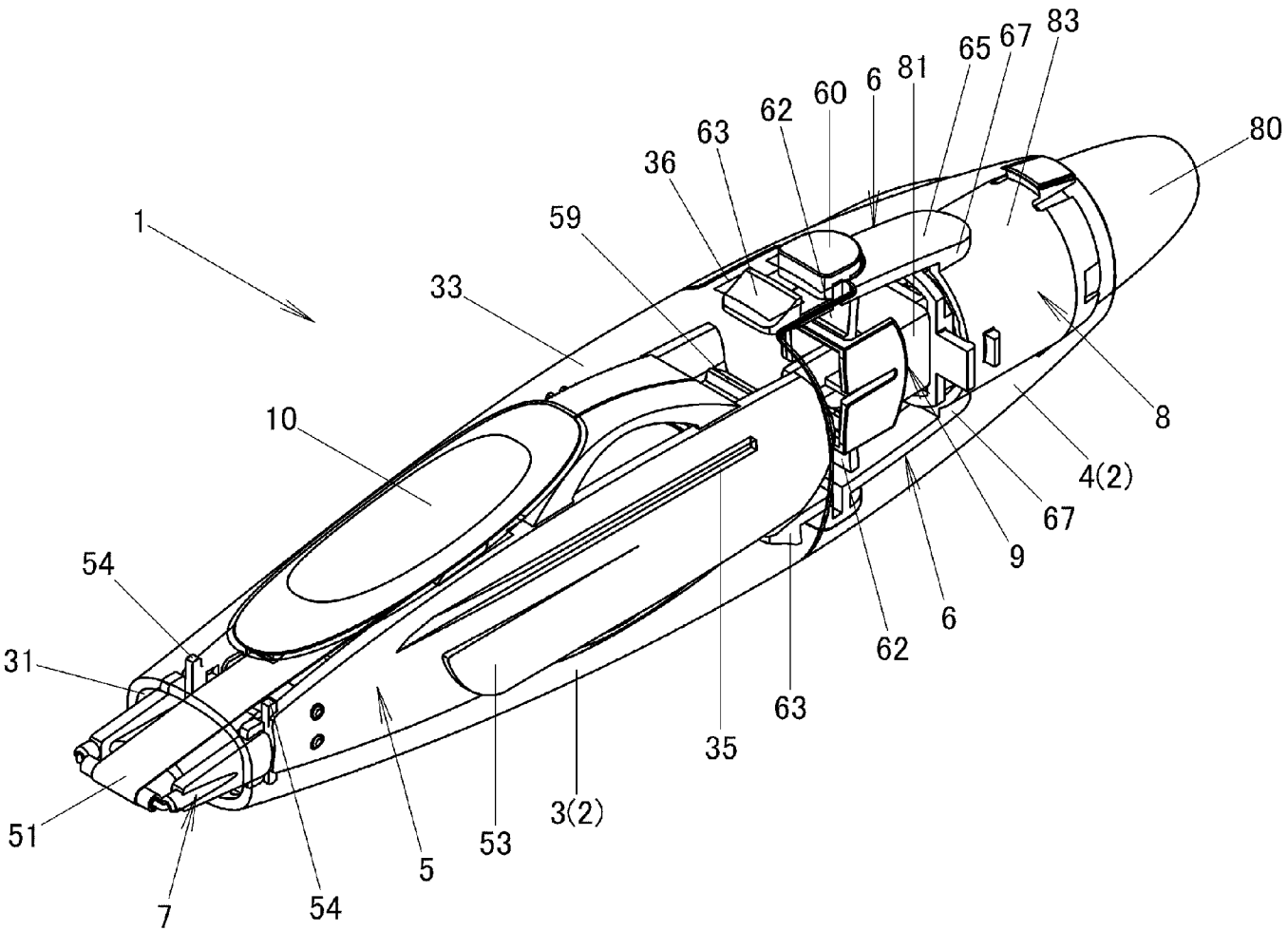
FIG. 7 is an external perspective view of the coating film transfer tool according to the embodiment of the invention showing a state in which the connection of a refill with an engagement portion is released.
Figure 8:
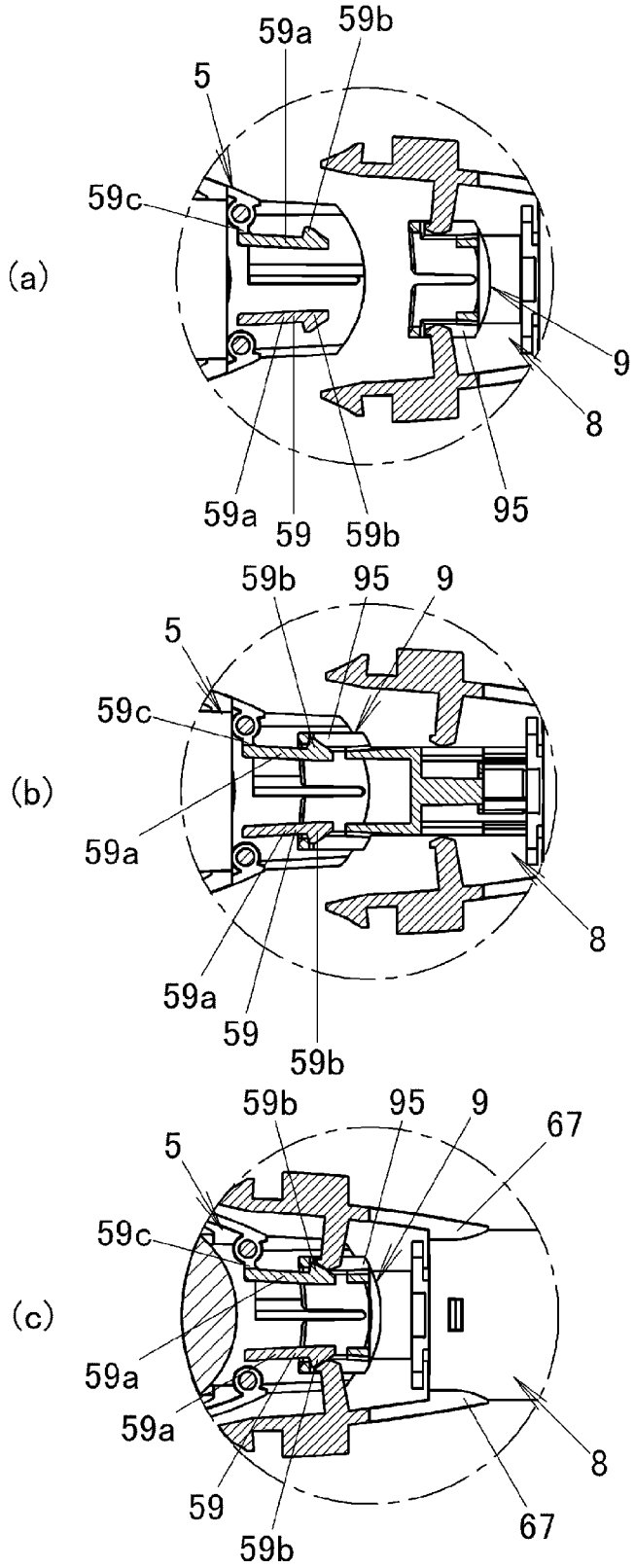
FIG. 8 shows partially enlarged views of the coating film transfer tool according to the embodiment of the invention showing a series of connecting operations between the refill and the engagement portion.

Next, a procedure will be described for replacing refills 5 by separating the case main body 2 of the coating film transfer tool 1 according to the embodiment into the front case 3 and the rear case 4. In addition, a procedure will also be described for switching the coating film transfer tool 1 where the replacement of refills 5 is completed between the useable state and the non-useable state. FIG. 6 shows a series of connection releasing operations in the coating film transfer tool 1 according to the embodiment, FIG. 7 is an external perspective view of the coating film transfer tool 1 according to the embodiment showing a state in which the connection of the refill 5 with the engagement portion 9 is released, and FIG. 8 shows partially enlarged views of the coating film transfer tool 1 according to the embodiment showing a series of connecting operations between the refill 5 and the engagement portion 9.

Firstly, when pressing the operating portions 60 of the connection release members 6 as pinching them with the finger tips in such a state that the coating film transfer tool 1 is in the non-useable state (refer to FIGS. 2 and 5), the connection release members 6 are pressed inwards as is shown in FIG. 6(*a*), whereby the plate-shaped members 65 are deflected inwards, and the pressing portions 62 press inwards the claws 59*b* of the engagement claw portions 59 of the refill 5 which are in engagement with the engagement openings 95 in the engagement portion 9. By the claws 59*b* being pressed inwards, the plate-shaped members 59*a* of the engagement claw portions 59 are deflected inwards, whereby the connection of the engagement portion 9 with the refill 5 is released.

In addition, since the plate-shaped members 59*a* of the engagement claw portions 59 are restored to their original states, even in the event that the refill 5 is moved to the front by virtue of the elastic force of the plate-shaped members 59*a*, stopper projections 54 which are provided in the vicinity of the transfer head 7 of the refill 5 are brought into engagement with bearing pieces 55 which are provided in the vicinity of the front end of the front case 3. Thus, the refill 5 is stopped from moving to the front by the front case 3.

Then, when pressing the operating portions 60 further inwards, the engaging attachment projections 63 of the connection release members 6 which are engagingly attached in the engaging attachment openings 36 in the front case 3 are disengaged therefrom as is shown in FIG. 6(*b*). This releases the connection of the front case 3 which accommodates therein the refill 5 with the rear case 4 as is shown in FIG. 6(*c*), whereby the front case 3 and the rear case 4 can be separated from each other.

Then, the refill 5 is removed from the front case 3, and a fresh refill 5 is inserted in the front case 3. When the fresh refill 5 is so inserted, the refill 5 is installed and held in the predetermined position by the front case 3. Specifically, the refill 5 is fixed in the predetermined position in the front case 3 through engagement of the bearing pieces 55 of the front case 3 with stopper projections 54 of the fresh refill 5. Then, by the engaging attachment projections 63 of the connection release members 6 which are secured to the rear case 4 being securely inserted in the engaging attachment openings 36 in the front case 3, the front case 3 can be engagingly attached to the rear case 4 as is shown in FIG. 7. Here, the tapered portions are formed on the engaging attachment projections 63, and therefore, the plate-shaped members 65 can be deflected smoothly, so that the engaging attachment projections 63 can securely be inserted in the engaging attachment openings 36.

Further, after the front case 3 has been engagingly attached to the rear case 4, the push button 80 is pushed so as to activate the push mechanism 8. Then, as is shown in FIG. 8(*a*), the engagement portion 9 which stays apart from the refill 5 moves to the front as is shown in FIG. 8(*b*). When engagement claw portions 59 are inserted inside the engagement portion 9, claws 59*b* of the engagement claw portions 59 of the refill 5 are engagingly attached to the engagement openings 95 in the engagement portion 9, whereby the refill 5 and the rear case 4 are coupled together via the engagement portion 9.

By the coupling of the refill 5 to the rear case 4 in the way described above, as is shown in FIGS. 1 and 4, the coating film transfer tool 1 is put in the useable state in which the transfer head 7 projects from the opening 31 in the front case 3. As this occurs, the bearing pieces 55 are in engagement with the stopper projections 54, and the refill 5 is fixedly disposed within the front case 3 so that the refill 5 is restricted from moving to the front. Because of this, the claws 59*b* of the engagement claw portions 59 of the refill 5 are securely inserted in the engagement openings 95 in the engagement portion 9 in a smooth fashion. In addition, the tapered portions are formed on the claws 59*b*, and therefore, plate-shaped members 59*a* can be deflected smoothly, so that the claws 59*b* are securely inserted in the engagement openings 95.

In this coating film transfer tool 1, the refill 5 is made integral with the rear case 4 via the engagement portion 9, and therefore, the occurrence of looseness in the front-to-rear direction is prevented when in used. In addition, in this coating film transfer tool 1, part of the refill 5 is brought into engagement with part of the front case 3 or a space defined therebetween is reduced to an extremely small level, and therefore, the occurrence of looseness in the left-to-right and up-to-down directions is prevented when in use.

When the push button 80 is pushed to activate the push mechanism 8 with the coating film transfer tool 1 staying in the useable state, the engagement portion 9 moves to the rear as is shown in FIG. 8(*c*). This enables the refill 5 to move to the rear together with the engagement portion 9 within the front case 3. Because of this, as is shown in FIGS. 2 and 5, the coating film transfer tool 1 can be put in the non-useable state in which the transfer heat 7 which is projecting from the opening 31 in the front case 3 is then installed in the front case 3.

Then, when the push button 80 is operated again to activate the push mechanism 8, the refill 5 moves to the front within the front case 3, so that the transfer head 7 installed in the front case 3 is caused to project to the front from the opening 31 in the front case 3. Thus, the coating film transfer tool 1 can be put in the useable state again (refer to FIGS. 1 and 4).

Namely, in this coating film transfer tool 1, once the refill 5 is connected to the engagement portion 9, the coating film transfer tool 1 can repeatedly be switched between the non-useable state in which the distal end (the transfer head 7) of the refill 5 is installed in the front case 3 and the useable state in which the distal end (the transfer head 7) of the refill 5 projects from the front case 3 every time the push mechanism 8 is activated by pushing the push button 80.

In this way, according to the invention, the front case 3 and the rear case 4 are detachably attached together, and the engagement portion 9 possessed by the rear case 4 and the refill 5 are detachably attached together. Because of this, the elastic member such as the coil spring which restores the push mechanism 8 can be disposed within rear case. Consequently, since the elastic member is disposed to the rear of the refill 5, there are no fears that the refill is forced out to the rear by virtue of the elastic force of the coil spring of the push mechanism, which occurred in the conventional coating film transfer tool. Thus, the separating operation of the main body case 2 into the front and rear cases 3, 4 can be performed in a smooth fashion.

In addition, according to the invention, in the separating operation of the main body case 2 for replacement of refills 5, the engaged state of the refill 5 with the rear case 4 and the engaged state of the front case 3 with the rear case 4 can be released through the single pressing operation of the connection release members 6.

In this coating film transfer tool 1, as is shown in FIG. 3, hooking projecting portions 53 are provided in laterally symmetrical positions on a left-hand external surface and a right-hand external surface of the refill 5 by increasing thicknesses of the left-hand external surface and the right-hand external surfaces of the refill 5.

Further, guide rails 35 which extend in the front-to-rear direction are provided so as to project inwards in laterally symmetrical positions on a left-hand internal surface and a right-hand internal surface of the front case 3 which are situated in the vicinity of the upper surface of the front case 3. Namely, in this coating film transfer tool 1, when the refill 5 is inserted into the front case 3 in such an orientation that the hooking projecting portions 53 reside on the sides where the guide rails 35 are formed, the hooking projecting portions 53 are made to contact and interfere with the corresponding guide rails 35.

Consequently, according to the invention, in the event that the refill 5 is inserted into the front case 3 with the left and right of the refill 5 erroneously reversed, the hooking projecting portions 53 provided on the refill 5 are brought into contact with the guide rails 35 provided on the front case 3 to thereby restrict the forward movement of the refill 5. Thus, the refill 5 cannot be inserted deep into the front case 3. Consequently, an erroneous insertion of the refill 5 can be prevented.

The invention is not limited to the embodiment that has been described heretofore and can freely be altered or improved without departing from the spirit and scope of the invention. For example, the connection release members 6 do not have to be formed integrally with the non-movable member 83. Thus, the connection release members 6 may be provided as separate members. Alternatively, the engagement portion 9 does not have to be formed integrally with the moving member 81. Thus, the engagement portion 9 may be provided as a separate member.

What is claimed is:

1. A coating film transfer tool comprising:

a refill; and a case main body, the refill being incorporated in the coating film transfer tool, having a feed spool around which an unused transfer tape is wound, a transfer head from which the transfer tape is suspended and which presses a coating film on the transfer tape against a transfer target so as to pressure-sensitively transfer the coating film on to the transfer target, and a take-up spool which takes up the transfer tape from which the coating film has been transferred, and being able to be replaced, the case main body accommodating therein the refill and comprising a front case in which an opening from which the transfer head is allowed to project is formed at a front end thereof, and a rear case having a push mechanism which causes the transfer head to appear from and disappear into the opening, wherein the rear case is detachably attached to the front case, wherein the push mechanism has an elastic member and an engagement portion which extends to the front from the push mechanism and moves in a front-to-back direction in the case main body according to the operation of the push mechanism, wherein the engagement portion is detachably attached to the vicinity of a rear end of the refill to support the refill, wherein the engagement portion and the refill are connected together by a pair of engagement claw portions, each of the pair of engagement claw portions provided in the vicinity of the rear end of the refill and at respective sides of the refill, and the pair of engagement claw portions being brought into engagement with each of a pair of engagement openings provided in the vicinity of a front end of the engagement portion and at respective sides of the engagement portion, wherein a connection release member which releases the connection of the engagement portion with the refill is secured to the rear case, and the connection release member is a pair of elastically deformable plate-shaped members which extend in the front-to-rear direction from respective sides of the rear case and each of the plate-shaped members has a pressing portion, an engaging attachment projection, and an operating portion, each pressing portion being caused to project inwards from its respective plate-shaped member, each engaging attachment projection being caused to project outwards from the vicinity of a front end of its respective plate-shaped member and adapted to be securely inserted into one of a pair of engaging attachment openings provided in the vicinity of a rear end of the front case and at respective sides of the front case, whereby the front case and the rear case are connected together, wherein each operating portion is formed so as to project outwards from its respective plate-shaped member, thereby projecting from a respective outer surface of the rear case, wherein by each of the operating portions of the connecting release member being simultaneously pressed from outside, each of the pressing portions presses against a respective one of the pair of engagement claw portions so that the pair of engagement claw portions are disengaged from their respective engagement opening to thereby release a connection of the engagement portion and the refill, and wherein by each of the operating portions of the connecting release member being simultaneously pressed further inwards, each of the engaging attachment projections are disengaged from their respective engaging attachment opening in the front case to thereby release a connection of the front case and the rear case.

2. A coating film transfer tool as set forth in claim 1, wherein the engagement portion comprises it of portions which are respectively provided to the rear of the engagement openings so as to restrict an inward movement of a respective one of the pressing portions of the connection release member, and in a usable state in which the transfer head projects from the opening in the front case, each of the pair of restricting portions is situated in the vicinity of the respective one of the pressing portion.

* * * * *